US005335737A

United States Patent [19]

Baugh

[11] Patent Number: 5,335,737

[45] Date of Patent: Aug. 9, 1994

[54] RETRIEVABLE WHIPSTOCK

[75] Inventor: Benton E. Baugh, Houston, Tex.

[73] Assignee: Smith International, Inc., Houston, Tex.

[21] Appl. No.: 978,842

[22] Filed: Nov. 19, 1992

[51] Int. Cl.[5] ..... E21B 7/08

[52] U.S. Cl. ..... 175/61; 166/117.6; 175/80; 175/81; 175/82

[58] Field of Search ..... 175/81, 82, 80, 79, 175/83; 166/117.6

[56] References Cited

U.S. PATENT DOCUMENTS

| | | | |
|---|---|---|---|
| 1,835,227 | 12/1931 | Lane et al. . | |
| 2,132,061 | 10/1938 | Walker | 166/117.6 |
| 2,207,920 | 7/1940 | Hughes | 175/82 X |
| 2,227,347 | 12/1940 | Johnson . | |
| 2,386,514 | 10/1945 | Stokes | 175/81 |
| 2,509,144 | 5/1950 | Grable et al. . | |
| 2,633,331 | 3/1953 | Hampton . | |
| 2,716,540 | 8/1955 | McCune et al. | 166/117.6 |
| 3,095,039 | 6/1963 | Kinzbach . | |
| 4,397,355 | 8/1982 | McLamore . | |
| 4,429,741 | 2/1984 | Hyland | 166/117.6 X |
| 4,765,404 | 8/1988 | Bailey et al. . | |
| 5,109,924 | 5/1992 | Jürgens et al. | 166/117.6 X |
| 5,154,231 | 10/1992 | Bailey et al. . | |
| 5,163,522 | 11/1992 | Eaton et al. | 166/117.6 X |

*Primary Examiner*—Hoang C. Dang
*Attorney, Agent, or Firm*—Robert G. Upton

[57] ABSTRACT

A retrievable whipstock which can be hydraulically set within a wellbore and following the drilling procedure mechanically released and retrieved for future use. The whipstock includes a whip which directs a milling tool from the main well and a hydraulically actuated packer or anchor for setting the whipstock in the wellbore. The whip includes ratchet teeth on its side edges for mating engagement with a retrieval tool. The retrieval tool includes a nose piece to ensure proper orientation relative to the whipstock and a clamping ring with ratchet teeth to engage the teeth of the whip. The whipstock is released through the application of tension through the retrieval tool allowing removal from the wellbore.

19 Claims, 4 Drawing Sheets

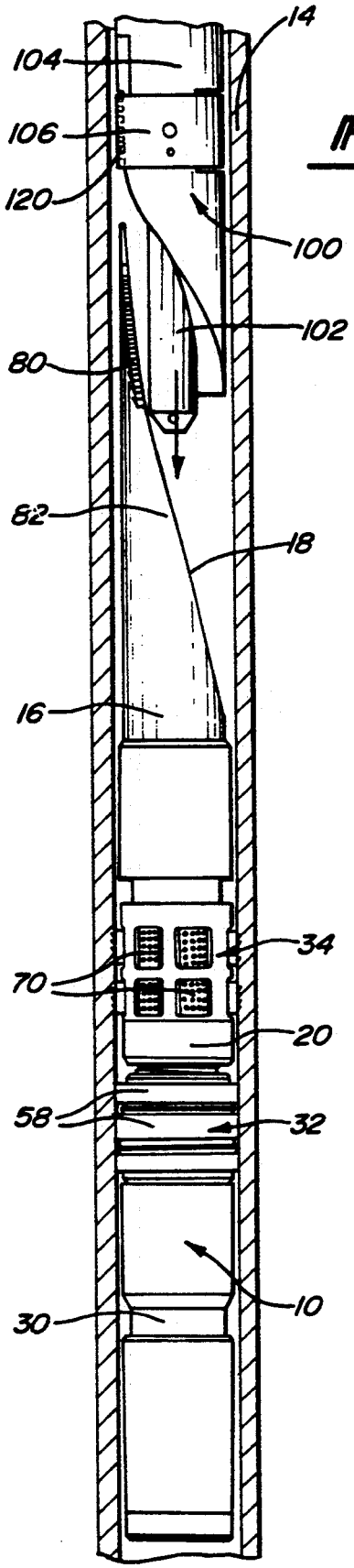
Fig-1
Fig-2
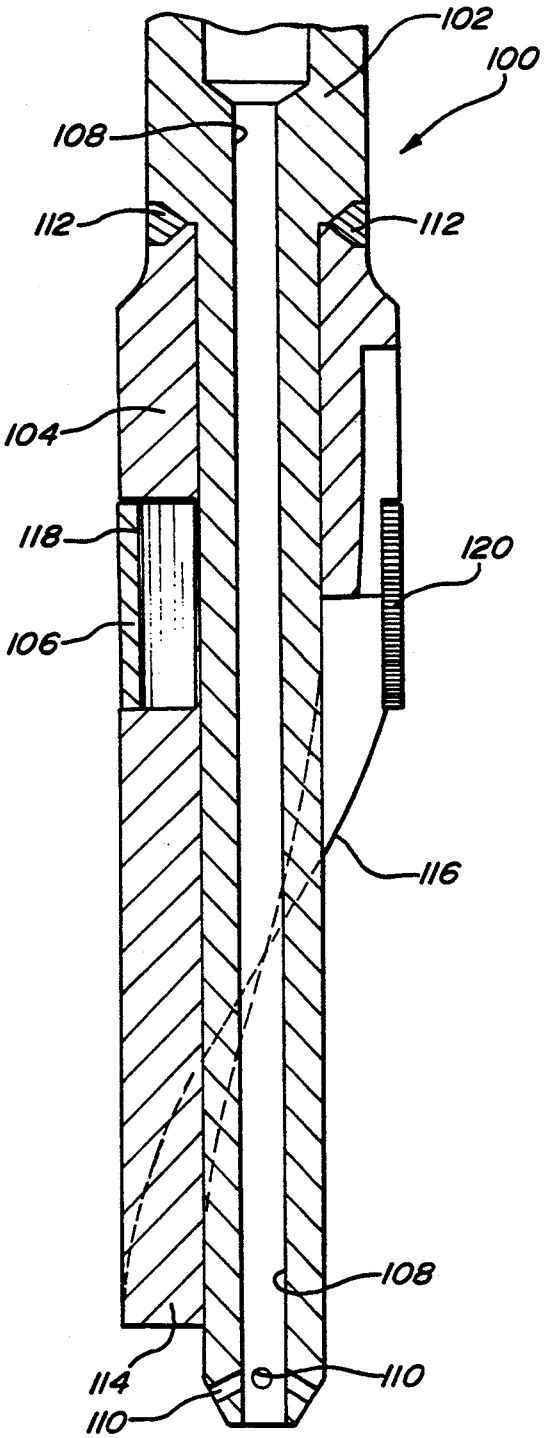

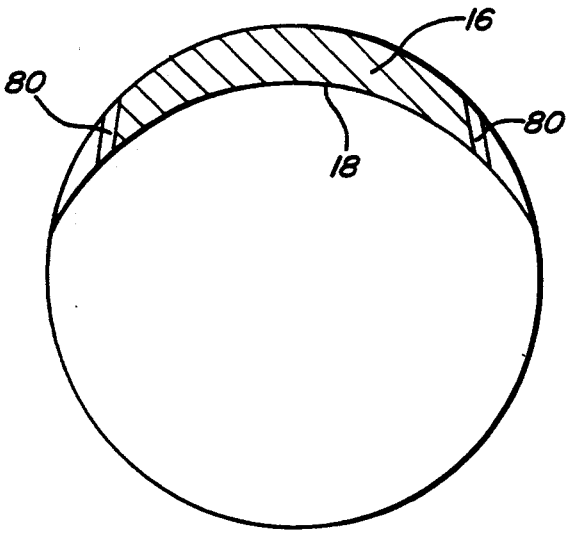
Fig-8
Fig-9
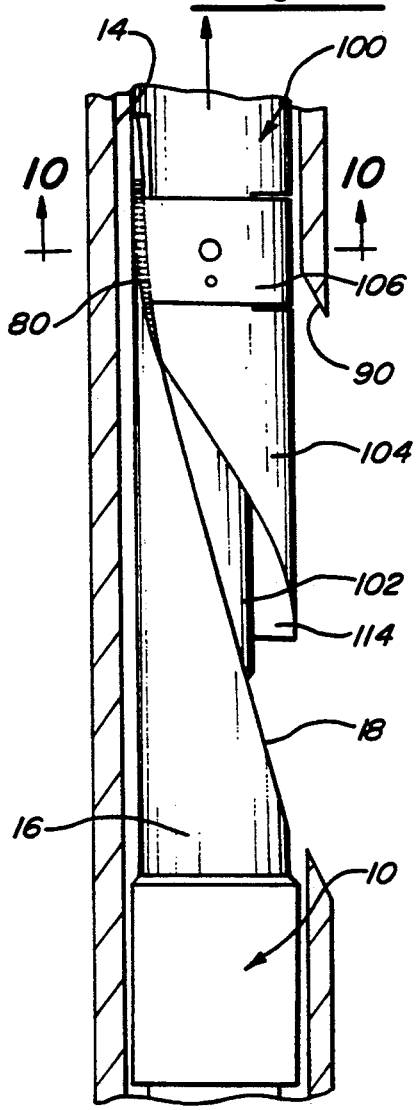
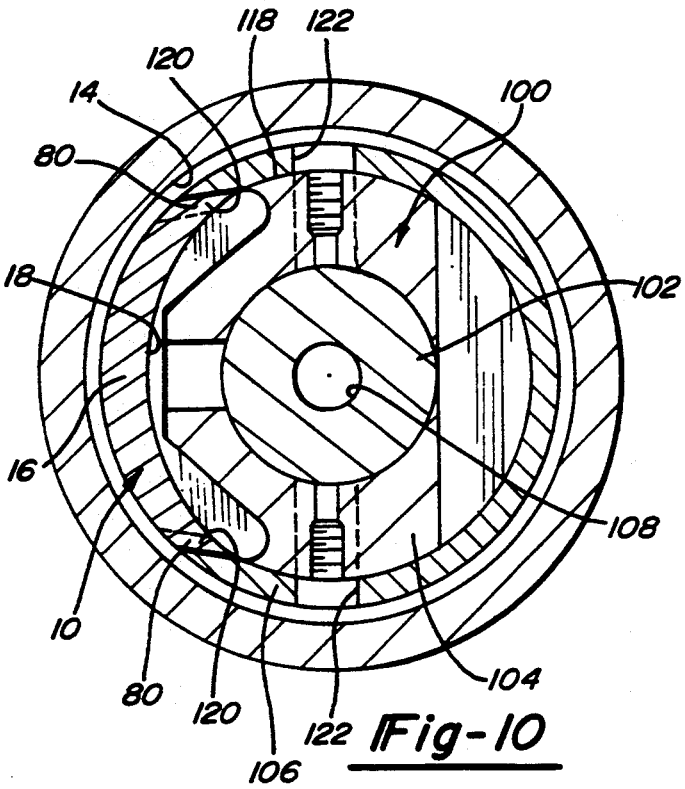
Fig-10

RETRIEVABLE WHIPSTOCK

BACKGROUND OF THE INVENTION

I. Field of the Invention

This invention relates to whipstocks for diverting the direction of drilling in a wellbore and, in particular, to a retrievable whipstock which may be hydraulically set within the well and mechanically retrieved once the drilling procedure is completed.

II. Description of the Prior Art

As drilling procedures have become increasingly sophisticated, the drilling of wellbores which deviate from the vertical or main wellbore has become more critical. Such direction changes can be a result of a course correction or the desire to explore different stratas of the geological formation. It has long been recognized that the simplest method of altering the wellbore was by positively directing the drilling tool in an alternative direction using a whipstock. Early whipstocks were simply placed at the bottom of the main wellbore where subsequent drilling operations would be diverted along the whip face. These early whipstocks may also have been anchored mechanically to ensure proper orientation of the whip face. However, no attempts were made to retrieve these whipstocks and they were typically abandoned in the well. As technology improved it became desirable to set the whipstock in the wellbore at specific positions above the bottom of the hole. Separate packers were first positioned in the well and the whip speared into the set packer. One-trip whipstocks were later developed which allowed the whip to be hydraulically set within the well and the casing milled in a single trip of the drill string. However, much like the early whips, once the wellbore was deviated, the whipstock would be abandoned in the well.

SUMMARY OF THE PRESENT INVENTION

The present invention overcomes the disadvantages of the prior known whipstocks by providing a whipstock which may first be set within the wellbore using hydraulic fluid pressure supplied from the surface and, following the directional drilling procedure, mechanically released and retrieved from the wellbore for use in subsequent drilling operations.

The retrievable whipstock assembly of the present invention includes a whip incorporating the sloped surface for directing a milling tool out of the wellbore, means for setting the whip within the wellbore, such as an anchor or packer, which actuated by hydraulic pressure, and a retrieval tool for mechanically engaging and removing the whip from the well. In order to facilitate engagement of the whipstock by the retrieval tool, the side edges of the whip include ratchet teeth which matingly engage a ratcheted C-ring on the retrieval tool. The anchor/packer subassembly is released upon application of shear tension through the retrieval tool and the entire assembly retrieved from the well. The retrieval tool is provided with orientating means for ensuring proper mating engagement of the ratchet surfaces and removal of the tool.

In a preferred embodiment, the retrievable packer subassembly includes packing elements and a slip assembly to set the tool within the well. Hydraulic pressure through the tool acts on a piston to set the slip assembly and packing elements. A ratcheted lock nut maintains the packer in the set position and also acts as the shear-out mechanism for releasing the packer. The whip attached to the packer subassembly includes the ratcheted side edges for engagement with the retrieval tool.

The retrieval tool includes a mandrel mounted within a sleeve having a nose to ensure proper orientation of the retrieval tool relative to the whip. Carried on the sleeve is an expandable C-ring which has a plurality of ratchet teeth adapted to engage the teeth of the whip to matingly connect the retrieval tool with the whipstock. Upon mating, a predetermined tension can be applied through the drill string to release the packer sub-assembly for retrieval of the tool. Once at the surface, the retrieval tool can be disconnected from the whipstock allowing reuse of the whipstock assembly. Thus, the present invention provides a hydraulically set whipstock to ensure secure placement yet which can be mechanically released and retrieved from the well.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 1 is a positioned view of the retrievable whipstock of the present invention set within a wellbore and the retrieval tool for engaging the whipstock;

FIG. 2 is a partial cross-sectional view of the retrieval tool;

FIG. 8 is a lateral cross-section taken along lines 8—8 of FIG. 7;

FIG. 9 is an enlarged perspective view of the retrieval tool matingly engaging the retrievable whipstock; and FIG. 10 is a lateral cross-section taken along lines 10—10 of FIG. 9.

DETAILED DESCRIPTION OF A PREFERRED EMBODIMENT OF THE PRESENT INVENTION

Referring first to FIG. 1, there is shown a combination whipstock 10 and retrieval tool 100 in a cased wellbore 14 embodying the present invention. The whipstock 10 is designed to be hydraulically-set within the wellbore 14 using hydraulic fluid pressure supplied from the surface through a detachable running tool or milling tool (not shown) used to position the whipstock 10. Following secondary drilling operations using the whipstock 10, such as milling a window in the casing of the wellbore, the whipstock 10 may be mechanically released and retrieved from the wellbore 14 for reuse in subsequent drilling operations. Thus, the present invention incorporates the secure setting force of a hydraulically actuated whipstock 10 with a mechanical release for retrieval of the whipstock 10.

Figure 7:
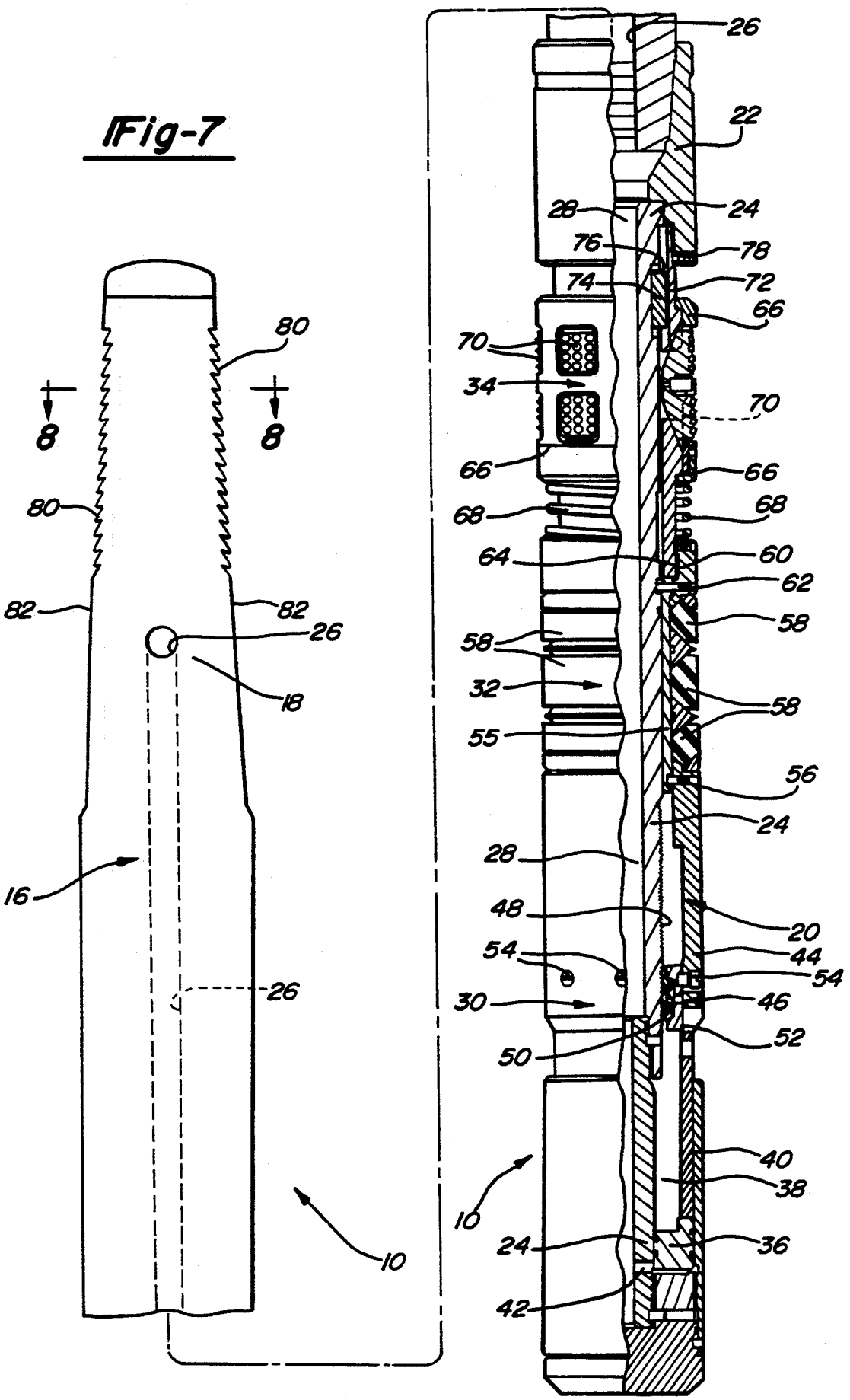
FIG. 7 is a partial cross-sectional view of the whipstock.

Referring now to FIGS. 1 and 7, the whipstock 10 includes a whip 16 having a whip face 18 for diverting a milling tool from the wellbore 14 and means attached to the whip 16 for setting the whipstock 10 at the desired position within the wellbore 14. In a preferred embodiment of the present invention, the setting means comprises a packer 20 although it is to be understood that a non-sealing anchor may be substituted therefor for securing the whipstock 10 within the wellbore 14. The whip 16 is typically connected to the packer 20 through a threaded sub 22 which is connected to an inner mandrel 24 of the packer 20. A fluid passageway 26 in the whip 16 communicates with an inner passageway 28 of the mandrel 24 through which hydraulic fluid pressure is supplied from the surface for setting the packer 20 as will be subsequently described.

The setting assembly of the packer 20 is mounted to the mandrel 24 and generally includes a setting/locking assembly 30, a packer assembly 32 and a slip assembly 34. The setting/locking assembly 30 includes a piston 36 which is slidably disposed within a cylinder 38 formed by the mandrel 24 and an outer wall 40. The cylinder 38 communicates with the inner passageway 28 through ports 42 such that the hydraulic fluid pressure will act on the piston 36 moving it longitudinally within the cylinder 38. The piston 36 in turn acts upon a lower packer retainer 44 which also carries the locking mechanism 46. The inner mandrel 24 in the vicinity of the locking mechanism 46 is provided with an outer ratchet surface 48 adapted to lockingly engage a ratchet surface of a locking nut 50 of the locking mechanism 46. The locking nut 50 is detachably connected to the lower packer retainer wall 44 by a locking nut holder 52 and a series of release shear screws 54. Thus, as the piston 36 moves within the cylinder 38 as a result of increased hydraulic pressure, the retainer wall 44 will similarly be affected moving the locking nut 50 along the ratchet surface 48 of the mandrel 24.

The lower packer retainer wall 44 is detachably connected to a mandrel sleeve 55 by lower shear screws 56. The mandrel sleeve 55 extends beneath the packing elements 58 and is detachably connected to upper retainer 60 by upper shear screws 62. The lower and upper retainers 44, 60 are designed to compress the packing elements 58 into sealing engagement with the wellbore wall 14 as will be described in conjunction with operation of the packer 20.

The upper retainer 60 is connected to a lower slip cone 64 of the slip assembly 34. A slip body 66 coaxially mounted to the lower slip cone 64 retains a spring 68 adapted to facilitate even setting of the slip assembly 34 against the wellbore wall 14. A plurality of slip elements 70 adapted to selectively engage the casing 14 are retained within the slip body 66. An upper slip cone 72 is connected to the mandrel 24 by a key 74 which is received in a slot 76 of the mandrel 24 and to the sub 22 by set screws 78. The lower and upper slip cones 64, 72 drive the slip elements 70 radially outwardly into engagement with the wall 14 upon setting of the packer as will be subsequently described.

The whip 16 attached to the packer 20 and in addition to the inclined whipface 18 also includes ratchet surfaces 80. These ratchet surfaces 80 are formed on the side edges 82 of the whipface 18 proximate the upper end of the whipstock although the ratchet surface 80 could wrap around the backside of the whip 16 if desired. The ratchet surface 80 facilitates mating engagement with the retrieval tool 100 and subsequent retrieval of the whipstock 10.

Figure 3:
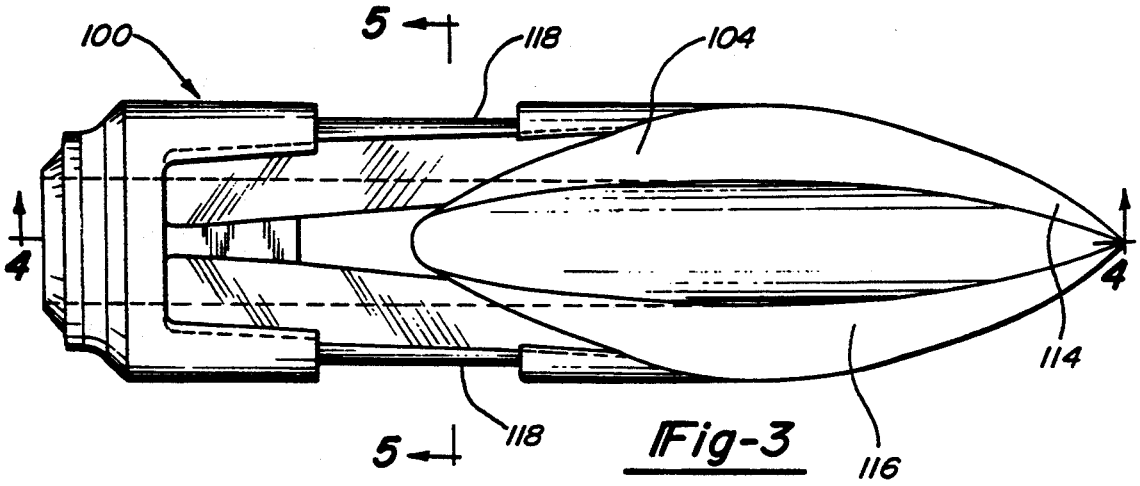
FIG. 3 is a perspective view of the sleeve of the retrieval tool.
Figure 4:
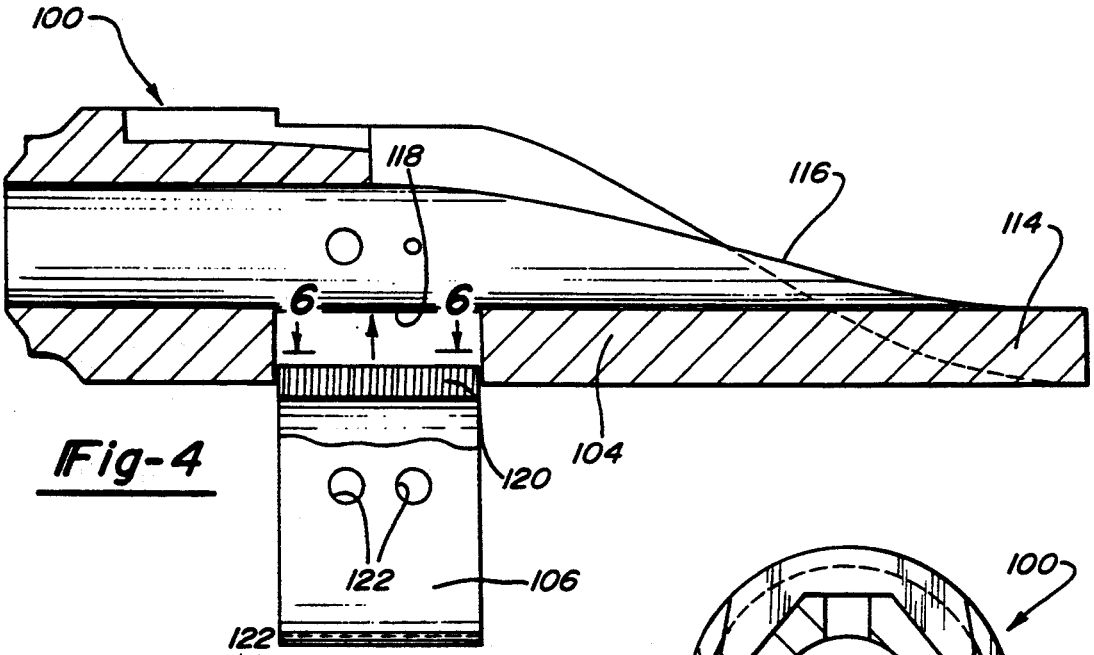
FIG. 4 is a cross-sectional view of the sleeve taken along lines 4—4 of FIG. 3 and showing the C-ring removed therefrom.
Figure 5:
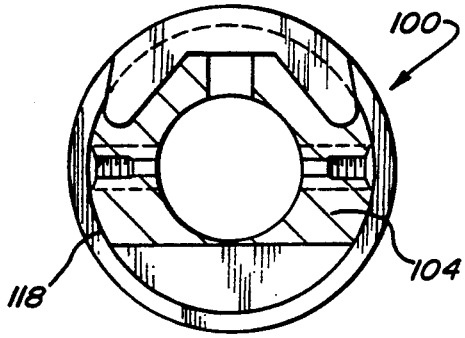
FIG. 5 is a lateral cross sectional perspective taken along lines 5—5 of FIG. 3.
Figure 6:
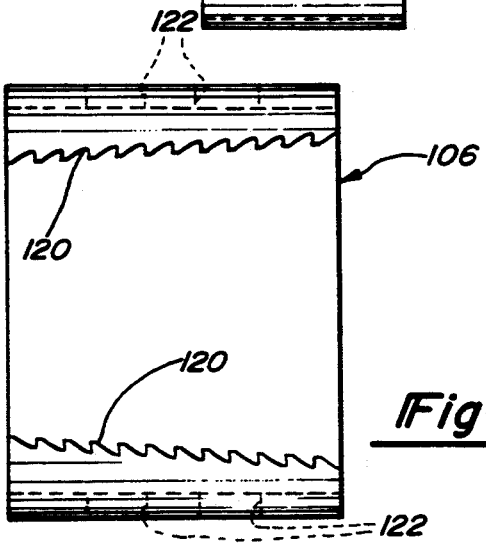
FIG. 6 is a perspective view of the expandable C-ring.

Referring now to FIGS. 1 through 6, the retrieval tool 100 comprises three primary components: a mandrel 102, a sleeve 104 coaxially mounted to the mandrel 102, and a ratchet ring 106 mounted to the sleeve 104. The mandrel 102 is preferably connected at its upper end to a well string and includes a central fluid passageway 108 with nozzles 110 at its lower end. The passageway 108 and nozzles 110 facilitate introduction of fluid to wash away any debris which may impede proper engagement of the retrieval tool 100 with the whipstock 10. The sleeve 104 is coaxially mounted to the mandrel 102 by weld 112. As best shown in FIG. 3, the sleeve 104 has a tapered configuration which forms an orientation nose 114. The sloped face 116 of the sleeve 104 also aids in orientating the retrieval tool 100 relative to the whipstock 10 by matingly engaging the face 18 of the whip 16. A reduced diameter neck portion 118 of the sleeve 104 is adapted to receive the ratchet ring 106 which preferably is an expandable C-ring to facilitate disconnection of the retrieval tool 100 from the whipstock 10. The C-ring 106 has inner ratcheted edges 120 designed to lockingly engage the ratchet edges 80 of the whip 16. Apertures 122 in the ratchet ring 106 facilitate expansion for disengagement from the whip 16 or removal of the C-ring 106 from the sleeve 104 as the ratchet teeth become worn.

Operation of the whipstock system of the present invention allows secure hydraulic setting of the whipstock 10 within the wellbore 14 and subsequent mechanical release and retrieval using the retrieval tool 100. The whipstock 10 is run into the wellbore 14 to the desired position using a simple running tool or a combination running tool and mill detachably connected to a whipstock 10. A fluid supply line from the surface through the running tool communicates with the passageways 26 and 28 to supply hydraulic fluid pressure to the packer 20. Once positioned, fluid pressure is increased through the inner passageway 28 which supplies fluid through the ports 42 into the cylinder 38. The hydraulic fluid pressure acts on the piston 36 which pushes against the lower retainer wall 44. As the lower retainer wall 44 moves longitudinally, the locking nut 50 moves along the ratchet surface 48 preventing movement of the lower retainer wall 44 in the opposite or downward direction. As the lower retainer wall 44 moves upwardly mandrel sleeve 55 will move upwardly which in turn acts upon the lower slip cone 64 and the upper retainer 60. Upon sufficient force, the upper shear screws 62 will first shear releasing the mandrel sleeve 55 from the mandrel 24. As the lower slip cone 64 moves towards the upper slip cone 72, which is fixed against movement, the slip elements 70 will be moved out against the wellbore wall 14. As the slip assembly 34 is set and additional force is applied to the lower retainer wall 44, the lower screws 56 will shear disconnecting the lower retainer wall 44 from the mandrel sleeve 55. Once released, the lower retainer wall 44 will compress the packing elements 58 into sealing engagement with the wellbore 14. When both the packing assembly 32 and the slip assembly 34 are fully set the lower retainer wall 44 will have moved the locking mechanism 46 along the ratchet surface 48 preventing downward movement of the lower retainer wall 44 and therefore release of the packer 20.

With the whipstock 10 set in the wellbore 14 the secondary drilling operation can be conducted. Examples of how the whipstock 10 may be used include milling a window 90 in the casing 14 for diverted drilling operations or simply diverting the direction of drilling from the main wellbore 14. As has been noted, the mill may have been tripped into the wellbore along with the whipstock 10 or the whipstock 10 may have been set using a running tool which is tripped out of the hole and followed by a secondary drilling tool.

Once the drilling operation is completed and it is desired to retrieve the whipstock 10, the retrieval tool 100 is tripped into the wellbore 14 for mating engagement with the whipstock 10. The retrieval tool 100 is self-orientating to ensure proper engagement. In addition, the nozzles 110 can be used to wash away mud and debris which may block access to the whipstock 10. In the event the ratchet edges 120 of the C-ring 106 are not in alignment with the ratchet surfaces 80 of the whip 16, the nose 114 of the retrieval tool 100 cause the tool to rotate into proper alignment. In the extreme example where the ratchet surfaces are 180° out of alignment, the tip of the nose 114 will contact the top of the whip 16. The tapered configuration of the nose 114 will cause the retrieval tool 100 to rotate in one direction or the other. The sloped surfaces of the whip face 18 and the sleeve 104 will continue this rotation until the ratchet edges are aligned. As the retrieval tool 100 continues to be lowered the ratchet edges 80 and 120 will lockingly engage connecting the retrieval tool to the whipstock 10.

With the whipstock 10 set in the wellbore 14, upward tension applied through the retrieval tool 100 will be transmitted through the whip 16 to the upper sub 22 of the packer 20. As this tension is applied to the sub 22, the upper slip cone 72 connected thereto will be immediately drawn upwardly transmitting the tension to the mandrel 24 through the key 74. Although the upper slip cone 72 has been partially withdrawn from beneath the slip elements 70, the slip assembly 34 will remain set. The tension applied to the mandrel 24 will be transmitted to the locking mechanism 46 through the engaged ratchets. As a threshold tension is reached the screws 54 will shear releasing the locking nut 50 and the nut holder 52 from the lower retainer wall 44. Consequently, the lower retainer wall 44 will move downwardly releasing the compression of the packing elements 58. Continued upward tension will draw the upper slip cone 72 and slip body 66 upwardly moving the slip elements 70 off of the lower slip cone 64 to retract the slip assembly 34. With both the packer assembly 32 and the slip assembly 34 retracted, the whipstock 10 is again free within the wellbore 14.

Retrieval of the whipstock 10 now simply requires tripping the entire assembly out of the wellbore 14. Once at the surface, the retrieval tool 100 can be detached from the whipstock 10 by prying the C-ring 106 apart to disengage the ratchet teeth and remove the whipstock 10. The whipstock 10 can be reused following replacement of the shear screws and resetting of the locking mechanism. Thus, the present invention provides a retrievable whipstock which is hydraulically-set within the wellbore and subsequently mechanically released for retrieval from the well.

The foregoing detailed description has been given for clearness of understanding only and no unnecessary limitations should be understood therefrom as some modifications will be obvious to those skilled in the art without departing from the scope and spirit of the appended claims.

What is claimed is:

1. A whipstock for changing the direction of drilling within a wellbore comprising:

a whip for diverting the direction of drilling, said whip including at least one ratchet surface;

means for setting said whipstock within the wellbore, said means attached to said whip such that said whip and setting means are run into the wellbore in a single trip, said setting means being actuated for setting said whipstock within the wellbore; and a retrieval tool for mechanically dislodging said setting means to retrieve said whipstock from the wellbore, said retrieval tool matingly engaging said whip and having at least one ratchet surface for lockingly engaging said at least one ratchet surface on said whip whereby tension applied through said retrieval tool is transmitted to said whipstock to mechanically dislodge said setting means.

2. The whipstock as defined in claim 1 wherein said setting means includes a locking nut engageable upon the application of hydraulic fluid pressure, said locking nut selectively preventing release of said setting means upon the interruption of hydraulic fluid pressure to said setting means.

3. The whipstock system as defined in claim 2 wherein said locking nut includes at least one shear bolt for selectively releasing said locking nut and said setting means, said at least one bolt shearable upon application of a predetermined threshold level of mechanical tension through said retrieval tool and whip to said locking nut.

4. The whipstock as defined in claim 3 wherein said setting means has an inner mandrel, said locking nut mounted to and movable along said inner mandrel upon actuation of said setting means, said mechanical tension transmitted from said means for dislodging said setting means through said mandrel to release said locking nut dislodging said setting means through said mandrel to release said locking nut dislodging said setting means.

5. The whipstock as defined in claim 4 wherein said mandrel includes a ratchet surface, said locking nut having a ratchet surface selectively engaging said ratchet surface of said mandrel to prevent release of said setting means.

6. The whipstock as defined in claim 5 wherein said setting means comprises a packer having at least one packing element movable into sealing engagement with the wellbore wall and at least one slip element engageable with the wellbore wall.

7. The whipstock as defined in claim 5 wherein said setting means comprises an anchor having at least one slip element movable into non-sealing engagement with the wellbore wall.

8. The whipstock as defined in claim 1 wherein said retrieval tool includes a nose for orientating said retrieval tool relative to said at least one ratchet surface on said whip for locking engagement of said whipstock to said retrieval tool.

9. The whipstock as defined in claim 8 wherein said retrieval tool includes an inner mandrel, a sleeve mounted to said inner mandrel and having said orientation nose, and a ratchet ring mounted to said sleeve for selective locking engagement with said at least one ratchet surface of said whip.

10. The whipstock as defined in claim 9 wherein said ratchet ring is an expandable C-ring having an inner ratchet surface, said C-ring selectively expandable for release of said whip from within said retrieval tool.

11. A retrievable whipstock system for changing the direction of drilling within a wellbore comprising:

a whip for diverting the direction of drilling, said whip including at least one ratchet surface;

means for setting said whipstock within the wellbore, said means attached to said whip such that said whip and setting means are run into the wellbore in a single trip, said setting means being hydraulically actuated to secure said whipstock within the wellbore; and a retrieval tool having a ratchet surface for mechanically dislodging said setting means to retrieve said whipstock from the wellbore, said retrieval tool selectively mated with said whip to engage said retrieval tool ratchet surface with said at least one ratchet surface on said whip in order to apply mechanical tension for retrieving said whipstock.

12. The whipstock system as defined in claim 11 wherein said retrieval tool includes a nose to orientate said ratchet surface of said retrieval tool with said at least one ratchet surface on said whip.

13. The whipstock system as defined in claim 11 wherein said setting means includes a locking nut engageable upon the application of hydraulic fluid pressure, said locking nut selectively preventing release of said setting means upon the interruption of hydraulic fluid pressure to said setting means.

14. The whipstock system as defined in claim 13 wherein said locking nut includes at least one shear bolt for selectively releasing said locking nut and said setting means, said at least one bolt shearable upon application of a predetermined threshold level of mechanical tension through said retrieval tool and whip to said locking nut.

15. A method of setting and retrieving a whipstock within a wellbore comprising the steps of:

running a combination whip and setting means into the wellbore in a single trip, said whip including at least one ratchet surface and a face for diverting drilling from the wellbore and said setting means being hydraulically actuable for selectively securing said whip within the wellbore;

supplying hydraulic fluid pressure to actuate said setting means, said setting means engaging the wellbore wall to secure said whip within the wellbore;

conducting secondary drilling operations using said whipstock set in the wellbore;

retrieving said whipstock by matingly engaging said whip with a retrieval tool, said retrieval tool having an inner ratchet surface lockingly engaging said at least one ratchet surface of said whip, applying mechanical tension to said setting means through said retrieval tool and whip to release said setting means, and pulling said retrieval tool and combination whip and setting means of the wellbore.

16. The method as defined in claim 15 wherein said setting means comprises a hydraulically-set packer having an inner mandrel, a slip assembly, at least one packing element compressible into sealing engagement with the wellbore wall, and a locking mechanism for preventing release of said packer upon elimination of hydraulic fluid pressure, said locking mechanism including a shear release whereby said locking mechanism is disengaged to release said packer upon application of a threshold tension to said inner mandrel through said whip and retrieval tool.

17. The method as defined in claim 16 wherein said locking mechanism includes a locking nut having an inner ratchet surface engageable with a ratchet surface on said inner mandrel upon application of hydraulic fluid pressure to said packer to move said locking nut in a first direction along said inner mandrel and at least one shear bolt engaging said locking nut for release to said locking mechanism upon application of said threshold tension.

18. The method as defined in claim 15 wherein said retrieval tool comprises an outer sleeve having an orientation nose and a ratchet ring mounted to said outer sleeve and incorporating said inner ratchet surface, said nose orientating said retrieval tool relative to said whip upon mating engagement such that said inner ratchet surface of said retrieval tool lockingly engages said at least one ratchet surface of said whip whereby tension can be applied through said retrieval tool and whip to release said setting means.

19. The method as defined in claim 18 and comprising the further step of disengaging said combination whip and setting tool from said retrieval tool at the surface following said retrieval step by expanding said ratchet ring to disengage said inner ratchet surface from said at least one ratchet surface of said whip.

* * * * *